United States Patent [19]

Myers

[11] Patent Number: 4,976,049

[45] Date of Patent: Dec. 11, 1990

[54] SCRUBBING SHOWER SANDAL

[76] Inventor: Ronald K. Myers, 440 N. State Line Rd., Sharon, Pa. 16146

[21] Appl. No.: 419,902

[22] Filed: Oct. 11, 1989

[51] Int. Cl.[5] ..... A43B 5/08; A43B 3/12

[52] U.S. Cl. ..... 36/8.1; 36/11.5; 15/159 A

[58] Field of Search ..... 36/8.1, 1, 11.5, 113, 36/86, 136, 132, 71.5; 15/227, 159 A

[56] References Cited

U.S. PATENT DOCUMENTS

| | | | |
|---|---|---|---|
| 1,823,445 | 9/1931 | Goldstone | 36/8.1 |
| 3,085,541 | 4/1963 | Leach | 36/83 |
| 3,290,802 | 12/1966 | Fukuoka | 36/11.5 |
| 3,384,915 | 5/1968 | Rands | 15/159 A |
| 3,605,292 | 9/1971 | Goldblatt | 36/8.1 |
| 3,798,699 | 3/1974 | Lewis, Jr. | 15/217 |
| 3,930,322 | 1/1976 | Endo et al. | 36/11.5 |
| 4,030,158 | 6/1977 | Blair et al. | 15/159 A |
| 4,288,883 | 9/1981 | Dorinsky | 15/159 A |
| 4,447,985 | 10/1984 | Yuan-Hsiang | 36/11.5 |
| 4,525,940 | 7/1985 | Mochizuki | 36/8.1 |
| 4,766,914 | 8/1988 | Briggs | 15/227 |
| 4,823,426 | 4/1989 | Bragga | 36/136 |

*Primary Examiner*—Steven N. Meyers
*Attorney, Agent, or Firm*—Brady, O'Boyle & Gates

[57] ABSTRACT

Shower sandals having a scrubbing surface provided on the top surface of the sandal strap so that a person can scrub the bottom of his feet by removing the sandal from one foot and move the foot across the scrubbing surface on the sandal being worn on the other foot.

9 Claims, 2 Drawing Sheets

SCRUBBING SHOWER SANDAL

BACKGROUND OF THE INVENTION:

Various sandals have been proposed for wearing in a bathing shower. These sandals usually include a base of elastomeric material, such as rubber, and an elastomeric strap portion which extends across the wearer's instep for holding the sandal on the wearer's foot. An example of such a sandal is disclosed in U.S. Pat. No. 4,226,031, dated Oct. 7, 1980.

These sandals are worn primarily to prevent the wearer from slipping in the shower and also for hygienic purposes, when using a public shower.

After considerable research and experimentation, the shower sandal of the present invention has been devised to provide the sandal strap with a scrubbing surface, whereby the wearer can scrub the bottoms of his feet without bending over.

The scrubbing shower sandal of the present invention comprises, essentially, a sandal having a base or foot supporting portion, a strap connected to the foot portion and adapted to extend across the wearer's instep for securing the sandal to the wearer's foot, and a scrubbing surface connected to the top surface of the strap. The scrubbing surface includes a plurality of bristles extending upwardly from the top surface of the strap, whereby the wearer can scrub the bottom of one foot by removing the sandal therefrom and placing the bottom of the foot on the bristles on the strap of the sandal being worn on the other foot.

Figure 1:
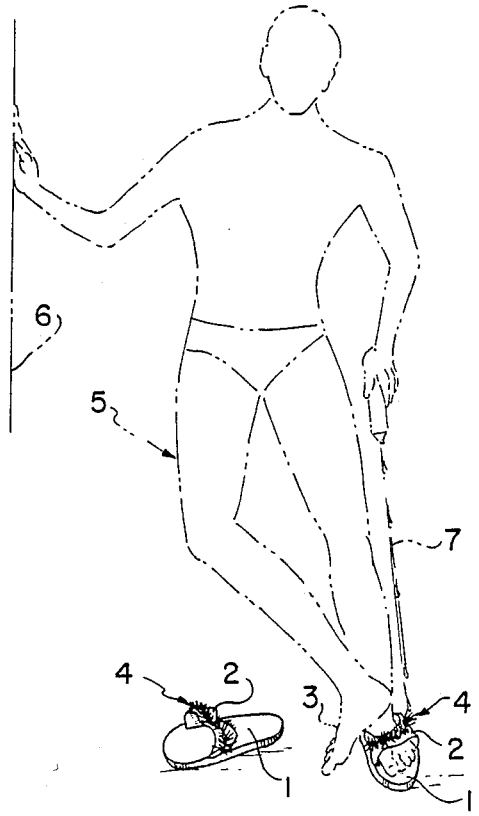
FIG. 1 is a perspective view showing the sandals of the present invention in use.

DESCRIPTION OF THE PREFERRED EMBODIMENTS:

Referring to the drawings and more particularly to FIG. 1, the scrubbing shower sandal of the present invention comprises, a sandal having a base or foot supporting portion 1, a strap 2 adapted to extend across the wearer's instep 3 for securing the sandal to the wearer's foot, and a scrubbing surface 4 connected to the top surface of the strap 2, whereby the wearer 5 can scrub the bottoms of his feet by placing his hand on the shower wall 6 for increased balance and remove a sandal from one foot, and without bending over, squirt a liquid detergent 7 on the scrubbing surface 4 on the other sandal being worn on the other foot. The wearer then moves the bottom of his foot back and forth over the scrubbing surface until the washing is complete. The procedure is then repeated for the other foot.

Figure 2:
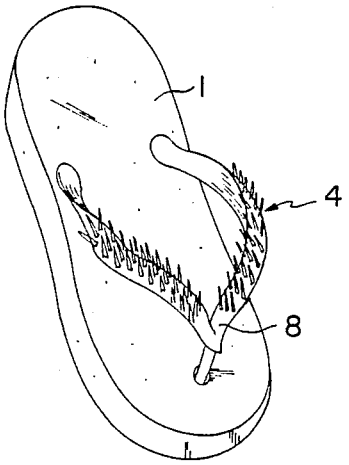
FIG. 2 is a perspective view of a thong type sandal having a scrubbing surface connected to the thong portion of the sandal.

FIG. 2 discloses the concept of placing the scrubbing surface 4 on a sandal having a thong-type strap 8.

Figure 3:
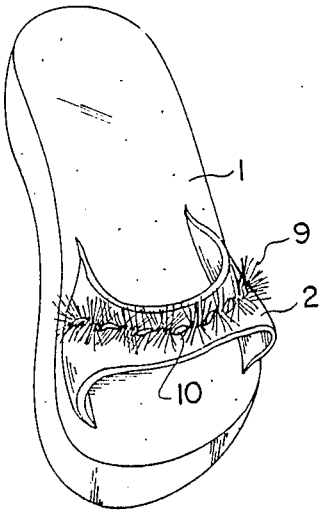
FIG. 3 is a perspective view of a sandal having a transversely extending strap portion with a scrubbing surface connected thereto.

FIG. 3 discloses an embodiment of a scrubbing surface which comprises a plurality of bristles 9 spirally wound on a wire core 10.

Figure 4:
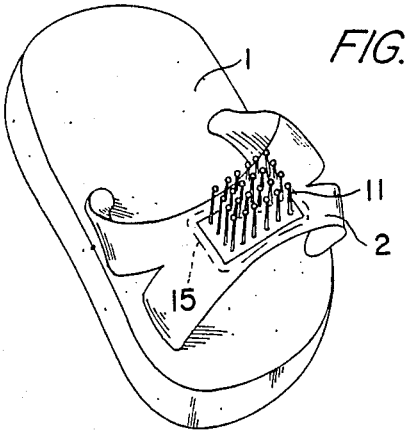
FIG. 4 is a perspective view of a sandal showing another embodiment of a scrubbing surface connected to the strap portion.
Figure 8:
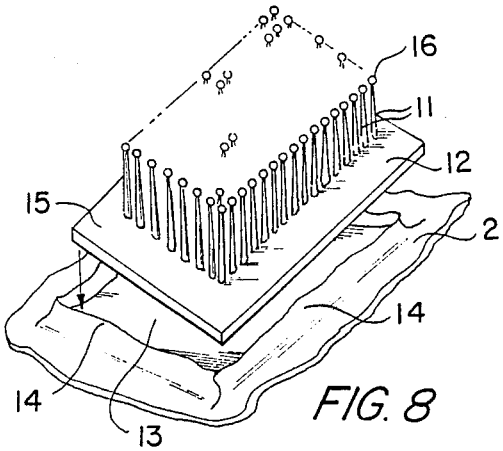
FIG. 8 is a fragmentary perspective view showing yet another embodiment for converting a scrubbing surface to the sandal strap.

FIGS. 4 and 8 illustrate another embodiment of the scrubbing surface wherein the bristles 11 are integrally connected to a base member 12 which is positioned in a pocket 13 provided in the strap portion 2 and adhesively secured therein, the edges 14 of the pocket extend over the peripheral edge portion 15 of the base member 12. The bristles 11 are tapered and somewhat rigid and formed with a bulbous portion 16 on the upper ends thereof. By this construction and arrangement, the wearer's foot obtains a massaging action while being washed.

Figure 5:
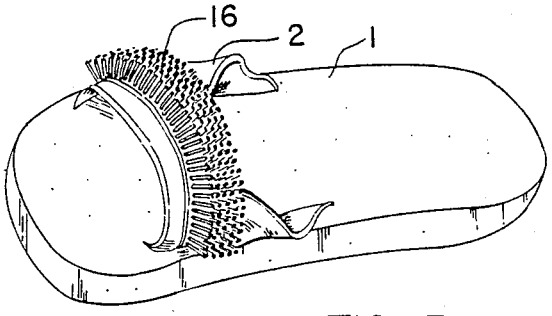
FIG. 5 is a perspective view of a sandal showing yet another embodiment of a scrubbing surface connected to the strap portion.

FIG. 5 illustrates yet another embodiment of a scrubbing surface wherein a plurality of flexible bristles 16 are arranged in rows and columns on the strap and extend transversely of the sandal coincident with the strap.

Figure 6:
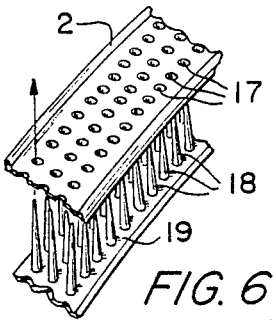
FIG. 6 is a fragmentary perspective view showing an embodiment of connecting a scrubbing surface to the sandal strap.

FIG. 6 illustrates yet still another embodiment of a scrubbing surface and a manner of securing the surface to a sandal strap 2, wherein the strap is provided with a plurality of apertures 17 for receiving a plurality of tapered, semi-rigid bristles 18 extending upwardly therethrough, the bases of the bristles being integrally connected to a carrier strip 19 which is adapted to be adhesively secured or integrally connected to the bottom surface of the strap 2.

Figure 7:
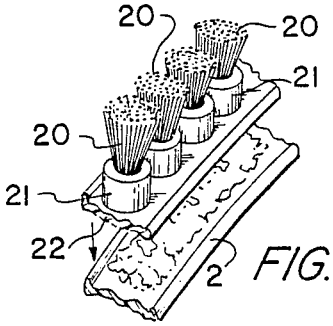
FIG. 7 is a fragmentary perspective view showing another embodiment for connecting a scrubbing surface to the sandal strap.

FIG. 7 illustrates another embodiment of a scrubbing surface and a manner of securing the surface to a sandal strap 2, wherein groups of bristles 20 are mounted within cylindrical base members 21 which are secured to a carrier strip 22 adapted to be adhesively secured to the top surface of the strap 2.

Figure 9:
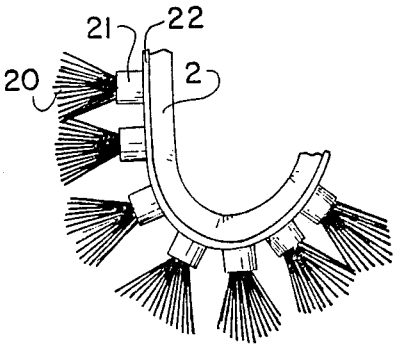
FIG. 9 is a fragmentary perspective view showing still another embodiment of a scrubbing surface wherein the scrubbing surface is an integral part of the sandal strap.

In FIG. 9, the scrubbing surface is similar to that of FIG. 7; however, the carrier strip 22 is an integral part of the sandal strap 2.

It will be understood by those skilled in the art, that the various embodiments of scrubbing surfaces and manner of attachment to the sandal strap can be readily applied to the thong-type sandal, shown in FIG. 2, as well as the transverse strap-type sandal as shown in FIGS. 3, 4 and 5.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. Scrubbing shower sandals comprising, a pair of foot supporting base members, a strap connected to each base member for removably holding each base member on a respective foot of a person, and a scrubbing surface mounted on the upper surface of each strap, said scrubbing surface comprising a plurality of spirally wound bristles secured to a wire core, said strap performing the dual function of holding the sandal on the foot of the person and as a support for the scrubbing surface, whereby the person can scrub the bottom of his feet by slipping a sandal off one foot, and moving the bottom of the foot back and forth across the top of the scrubbing surface on the strap of the sandal being worn on the other foot.

2. Scrubbing shower sandals comprising, a pair of foot supporting base members, a strap connected to each base member for removably holding each base member on a respective foot of a person, and a scrubbing surface mounted on the upper surface of each strap, said scrubbing surface comprising a plurality of semi-rigid tapered bristles, said strap performing the dual function of holding the sandal on the foot of the person and as a support for the scrubbing surface, whereby the person can scrub the bottom of his feet by slipping a sandal off one foot and moving the bottom of the foot back and forth across the top of the scrubbing surface on the strap of the sandal being worn on the other foot.

3. Scrubbing shower sandals according to claim 2, wherein bulbous portions are provided on the tops of said bristles.

4. Scrubbing shower sandals according to claim 2, wherein the sandal strap is provided with a plurality of apertures for receiving the tapered bristles upwardly therethrough, the bases of said bristles being connected to a carrier strip, said carrier strip being secured to the bottom surface of said strap.

5. Scrubbing shower sandals according to claim 3, wherein the bristles are secured to a base member, a pocket provided on the top surface of the strap, said base member being positioned within said pocket and secured therein.

6. Scrubbing shower sandals comprising, a pair of foot supporting base members, a strap connected to each base member for removably holding each base member on a respective foot of a person, and a scrubbing surface mounted on the upper surface of each strap, said scrubbing surface comprising a plurality of bristles arranged in rows and columns and extending across the sandal coincident with the strap, said strap performing the dual function of holding the sandal on the foot of the person and as a support for the scrubbing surface, whereby the person can scrub the bottom of his feet by slipping a sandal off one foot and moving the bottom of the foot back and forth across the top of the scrubbing surface on the strap of the sandal being worn on the other foot.

7. Scrubbing shower sandals comprising, a pair of foot supporting base members, a strap connected to each base member for removably holding each base member on a respective foot of a person, and a scrubbing surface mounted on the upper surface of each strap, said scrubbing surface comprising a plurality of bristles arranged in groups, each group of bristles being mounted within a cylindrical base member, each base member being mounted on a carrier strip, said carrier strip being secured to the top surface of the strap, said strap performing the dual function of holding the sandal on the foot of the person and as a support for the scrubbing surface, whereby the person can scrub the bottom of his feet by slipping a sandal off one foot and moving the bottom of the foot back and forth across the top of the scrubbing surface on the strap of the sandal being worn on the other foot.

8. Scrubbing shower sandals according to claim 7, wherein the carrier strip is adhesively secured to the strap.

9. Scrubbing shower sandals according to claim 7, wherein the carrier strip is integrally formed with the strap.

* * * * *